US007500279B2

(12) United States Patent
Jackson

(10) Patent No.: US 7,500,279 B2
(45) Date of Patent: Mar. 10, 2009

(54) SLEEP DEVICE

(75) Inventor: Elfrem Jackson, 3480 Greenbriar Pkwy. SW., Suite 212, Atlanta, GA (US) 30331

(73) Assignee: Elfrem Jackson, Atlanta, GA (US)

( * ) Notice: Subject to any disclaimer, the term of this patent is extended or adjusted under 35 U.S.C. 154(b) by 0 days.

(21) Appl. No.: 11/681,040

(22) Filed: Mar. 1, 2007

(65) Prior Publication Data

US 2008/0209637 A1 Sep. 4, 2008

(51) Int. Cl.

| | |
|---|---|
| ***A47C 16/00*** | (2006.01) |
| ***A47C 20/02*** | (2006.01) |
| ***B68G 5/00*** | (2006.01) |
| *A47C 20/00* | (2006.01) |
| *A47C 1/10* | (2006.01) |
| *A47C 7/36* | (2006.01) |
| *A61G 15/00* | (2006.01) |
| *B60R 22/28* | (2006.01) |

(52) U.S. Cl. ..... 5/657; 5/636; 297/392; 128/845

(58) Field of Classification Search ..... 5/636, 5/637, 639, 640, 652, 657; 297/393, 392; 138/96 R; 128/845

See application file for complete search history.

(56) References Cited

U.S. PATENT DOCUMENTS

| | | | | |
|---|---|---|---|---|
| 3,008,464 | A * | 11/1961 | Atkins | 601/39 |
| 7,055,908 | B1 * | 6/2006 | Williams | 297/392 |
| 2008/0109960 | A1 * | 5/2008 | Brown et al. | 5/636 |

* cited by examiner

*Primary Examiner*—Patricia L Engle
*Assistant Examiner*—Jonathan J Liu
(74) *Attorney, Agent, or Firm*—Nelson Mullins Riley & Scarborough, L.L.P.

(57) ABSTRACT

A sleep device for use in a seated position comprises a hollow shaped body formed from a resilient polymer having a plurality of sidewalls extending generally parallel to a central longitudinal axis, a top surface centered about the central axis, the top surface being adapted to receive the chin of a user, a recess intermediate the top surface and the plurality of sidewalls, and an annular bottom edge. A base is formed from the resilient polymer having a bottom surface, a vertical wall extending from the base, and a radial flange. The base is fastened to the body annular bottom edge by for example an adhesive or other suitable fastening means. In some embodiments, the body and base are fastened to create an airtight seam.

13 Claims, 5 Drawing Sheets

SLEEP DEVICE

FIELD OF THE INVENTION

This invention relates to a pillow and, more particularly, is directed to a traveler's pillow.

BACKGROUND OF THE INVENTION

Travelers are typically forced to sleep in an upright position on an airplane, train or bus. Sleeping in this position can often result in neck and back pain due to inadequate neck support. That is, because the traveler's head can tilt from side to side or forward as they sleep, an undue amount of stress is placed on the neck and back. As a result of this problem pillows, as shown in prior art FIGS. 1 to 3, have been developed. For example, FIGS. 1-2 illustrate a horseshoe-shaped collar that fits around the neck and sits on the shoulders of the user. The pillow may be inflatable or stuffed with foam or other suitable stuffing material. This type of pillow design can prevent the user's head from tilting sharply to one side or the other. However, pillows of this design fail to stop the user's head from tilting forward. In an effort to prevent the user's head from tilting forward, the prior art pillow illustrated in FIG. 3 was introduced. However, these types of pillows are not acceptable alternatives for the most demanding travelers since they are bulky to carry or inconvenient to blow up if they are inflatable. Moreover, the pillow shown in FIG. 3 is bulky and inconvenient to use in the confinement of most coach airplane seats.

SUMMARY OF THE INVENTION

The accompanying drawings, which are incorporated in and constitute a part of this specification, illustrate one or more embodiments of the invention and, together with the description, serve to explain the principles of the invention.

These and/or other objects are achieved in a preferred embodiment of a travel pillow comprising a hollow shaped body formed from a resilient polymer having a plurality of sidewalls extending generally parallel to a central longitudinal axis, a top surface centered about the central axis, the top surface being adapted to receive the chin of a user, a recess intermediate the top surface and the plurality of sidewalls, and an annular bottom edge. A base is formed from the resilient polymer having a bottom surface, a vertical wall extending from the base, and a radial flange. The base is fastened to the body annular bottom edge by for example an adhesive or other suitable fastening means. In some embodiments, the body and base are fastened to create an airtight seam. The body sidewalls are less than approximately six inches tall.

In a preferred embodiment, the resilient polymer may be an injectable elastomer or thermoplastic material. In one preferred embodiment, the body sidewalls are approximately three inches tall. In some embodiments, the hollow shaped body can compress in height along the central longitudinal axis by approximately twenty percent. In other embodiments, the hollow body contains resilient filler such as Styrofoam beads. In yet other embodiments, the body is generally triangular in shape with respect to a cross-section taken perpendicular to the central longitudinal axis. In some embodiments, the body comprises three sidewalls integrally formed with each other and the top surface.

The above objects are also achieved by a method for using a travel pillow when in a seated position comprising the steps of providing a travel pillow having a hollow shaped body and a base. The body is formed from a resilient polymer having a plurality of sidewalls extending generally parallel to a central longitudinal axis, a top surface centered about the central axis, the top surface being adapted to receive the chin of a user, a recess intermediate the top surface and the plurality of sidewalls, and an annular bottom edge. The base is formed from the resilient polymer, wherein the base is fastened to the body and the pillow is less than approximately six inches tall. The pillow is inserted between the users chin and chest so that the base rests on the user's chest and the user's chin rests on the body top surface.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which:

FIG. 3 FIG. 1 is a perspective view of a prior art travel pillow;

Figure 1:
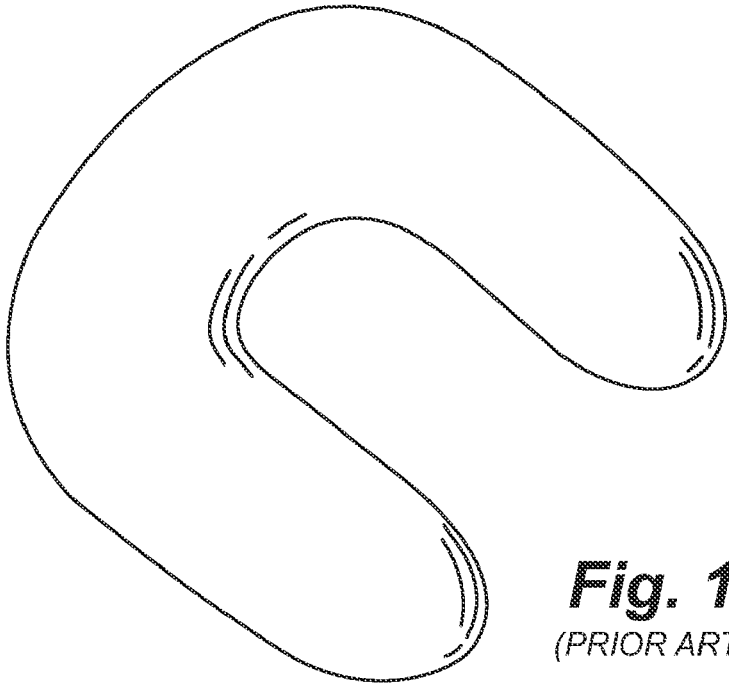
Fig. 1 (PRIOR ART)
FIG. 1 is a perspective view of a prior art travel pillow.
Figure 2:
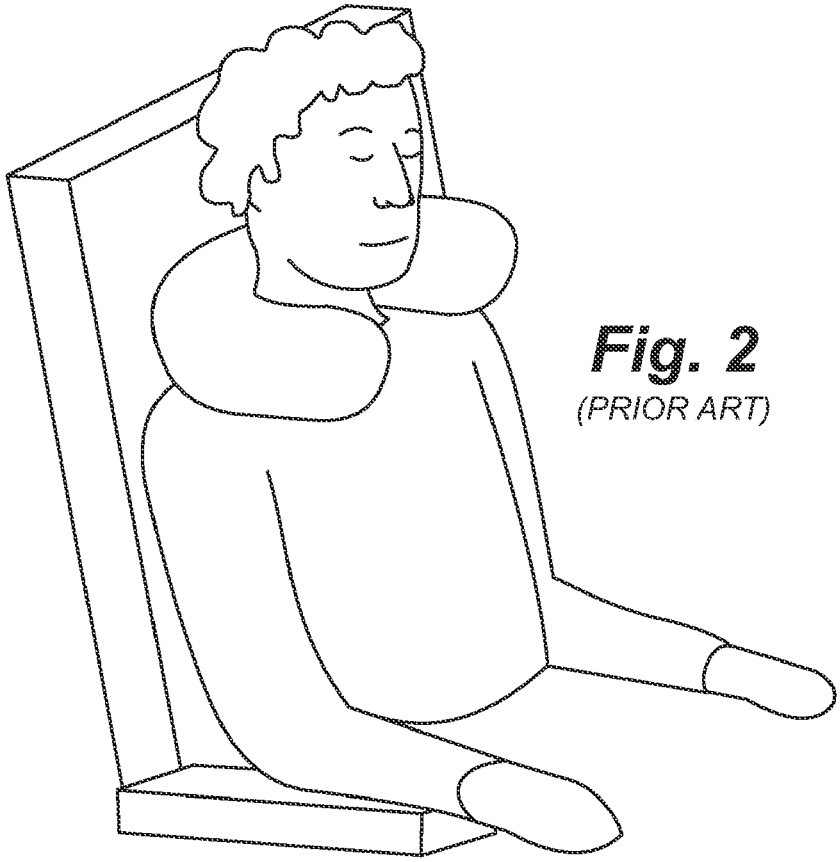
Fig. 2 (PRIOR ART)
FIG. 2 is a perspective view of the prior art travel pillow shown in FIG. 1.
Figure 3:
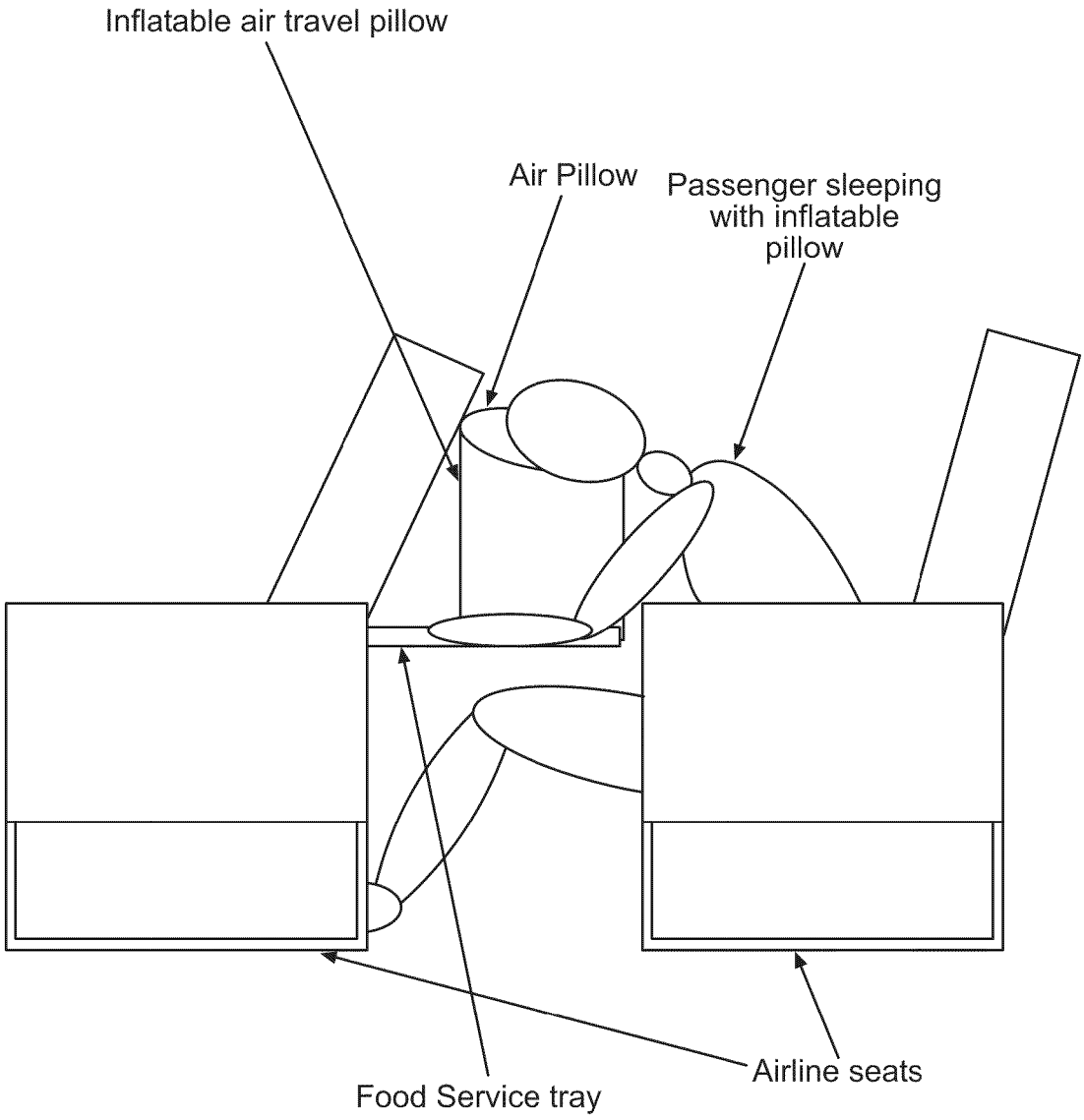
Fig. 3 (PRIOR ART)

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 4:
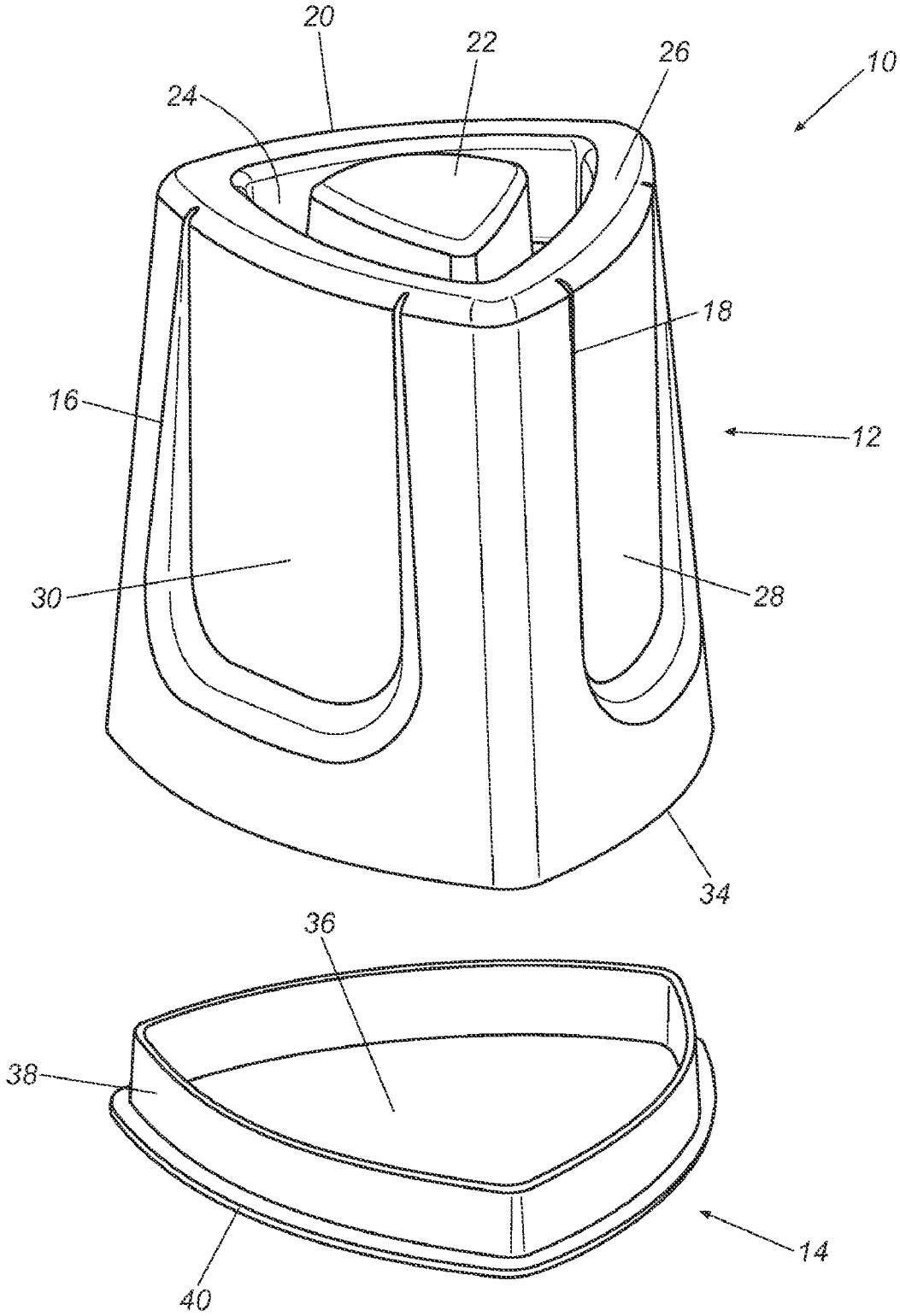
FIG. 4 is an exploded perspective view of a travel pillow in accordance with an embodiment of the present invention.
Figure 5:
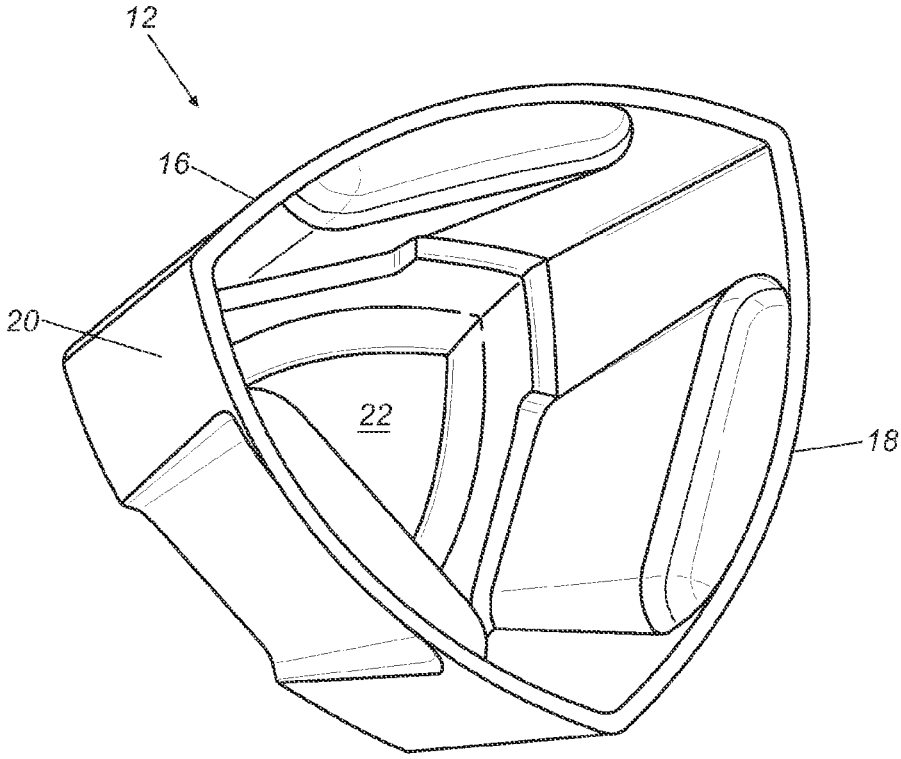
FIG. 5 is a bottom view of the travel pillow of FIG. 4.
Figure 6:
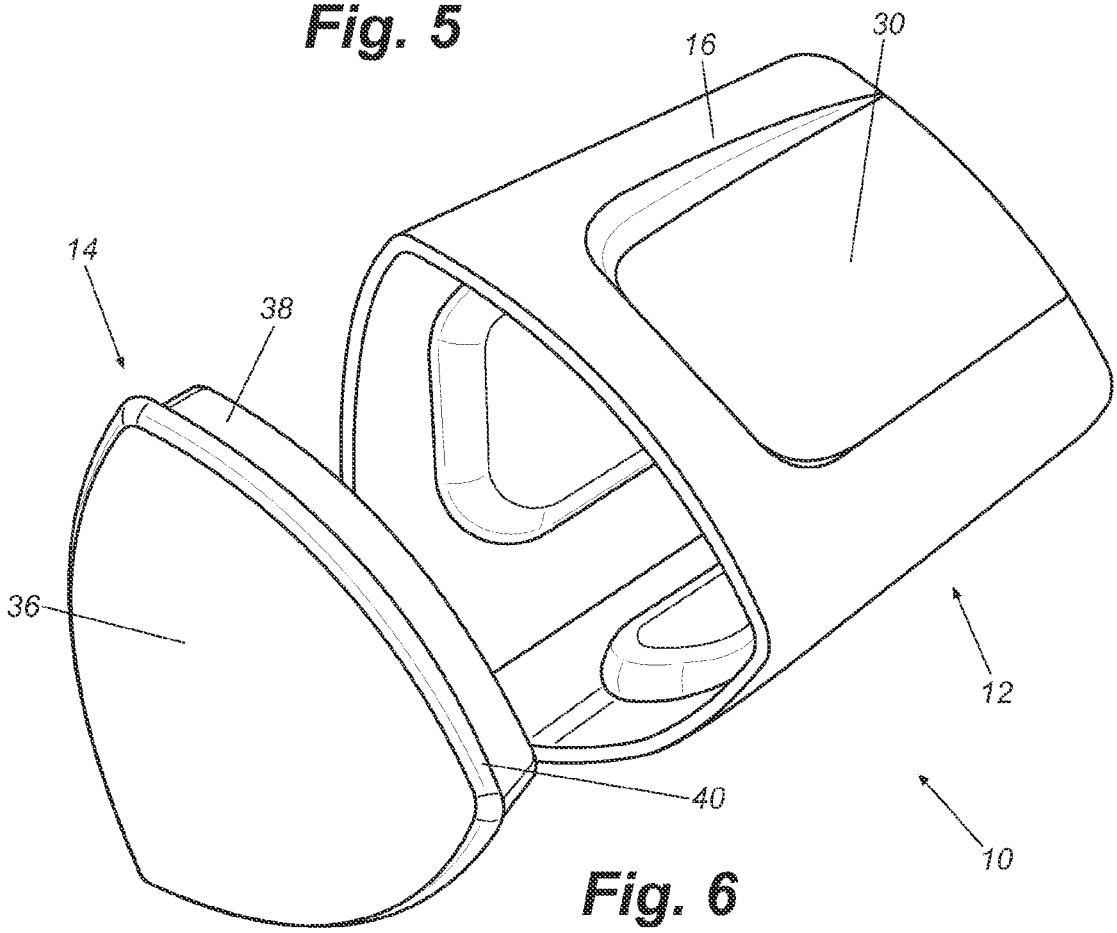
FIG. 6 is an exploded perspective view of the travel pillow of FIG. 4.

Referring to FIGS. 4-6, a pillow 10 is shown having a body 12 and a base 14 formed from a resilient elastomer of polymer, for example a thermoplastic elastomer, injection moldable grades of rubber and vinyl varying in durometer ranges suitable for its intended use. One such example of material is Santoprene by Monsanto Company of St. Louis, Mo. Other suitable polymers and elastomers may be used so long as they can be blow-molded, injection-molded (single or double shot) or pour-molded.

In one embodiment, body 12 is triangular in shape and has a first side wall 16, a second side wall 18 and a third side wall 20 each respectively connected to an adjacent wall by a rounded corner. Body 12 has a top surface defined by a center portion 22 and a rim portion 26 separated by a recess 24. Center portion 22 should be sized and shaped to receive an average sized chin of a user and may be hollow or solid in nature depending on the intended use of the pillow.

Body 12 may be formed by injection molding the material to form a hollow shaped body. In a preferred embodiment, the sidewall thickness is 0.093 inches. It should be understood to those skilled in the art that sidewall thickness may be varied depending on the material used and the desired amount of compression of body 12. As illustrated in FIGS. 4-6, sidewalls 16, 18 and 20 are formed with recessed portions 28 and 30 (only two are shown in the Figure). This configuration provides thicker wall portions where two adjacent walls meet. Additionally, ribs (not shown) may be formed on the inside surface of the sidewalls to provide added rigidity to the body structure. Body 12 terminates at a lower edge 34, which defines a hollow cavity (not shown) within the body.

Base 14 is formed from the same material as body 12 and is generally shaped to match the shape of body 12. In a preferred embodiment, base 12 is triangular in shape and has a bottom surface 36, a vertical extending wall 38 and a flange 40. The radial width of flange 40 is sized to receive body lower edge 34. Base 14 may be attached to body 12 by adhesive or other suitable means of securing the base to the body. In a preferred embodiment, flange 40 is dipped in a suitable solvent and upper body 12 is secured to base 14 for an appropriate time to provide an airtight seal between the parts.

In a preferred embodiment, pillow 10 may be approximately 3-¼ inches tall at rest for use by an average sized man or woman. The height may be varied to accommodate different sized users, for example tall people or kids, or based on the average amount of compression achieved by the chosen wall thickness and material resiliency. In general, the length of body 12 should not exceed ten inches and is preferably no more than six inches. In one embodiment, the width of body 12 may be about five inches across so that pillow 10 may fit comfortably in a briefcase or purse with minimal or no compression. It should also be understood that the shape of body 12 and base 14 may vary and can be rounded, squared cylindrical or polygonal in shape.

Figure 7:
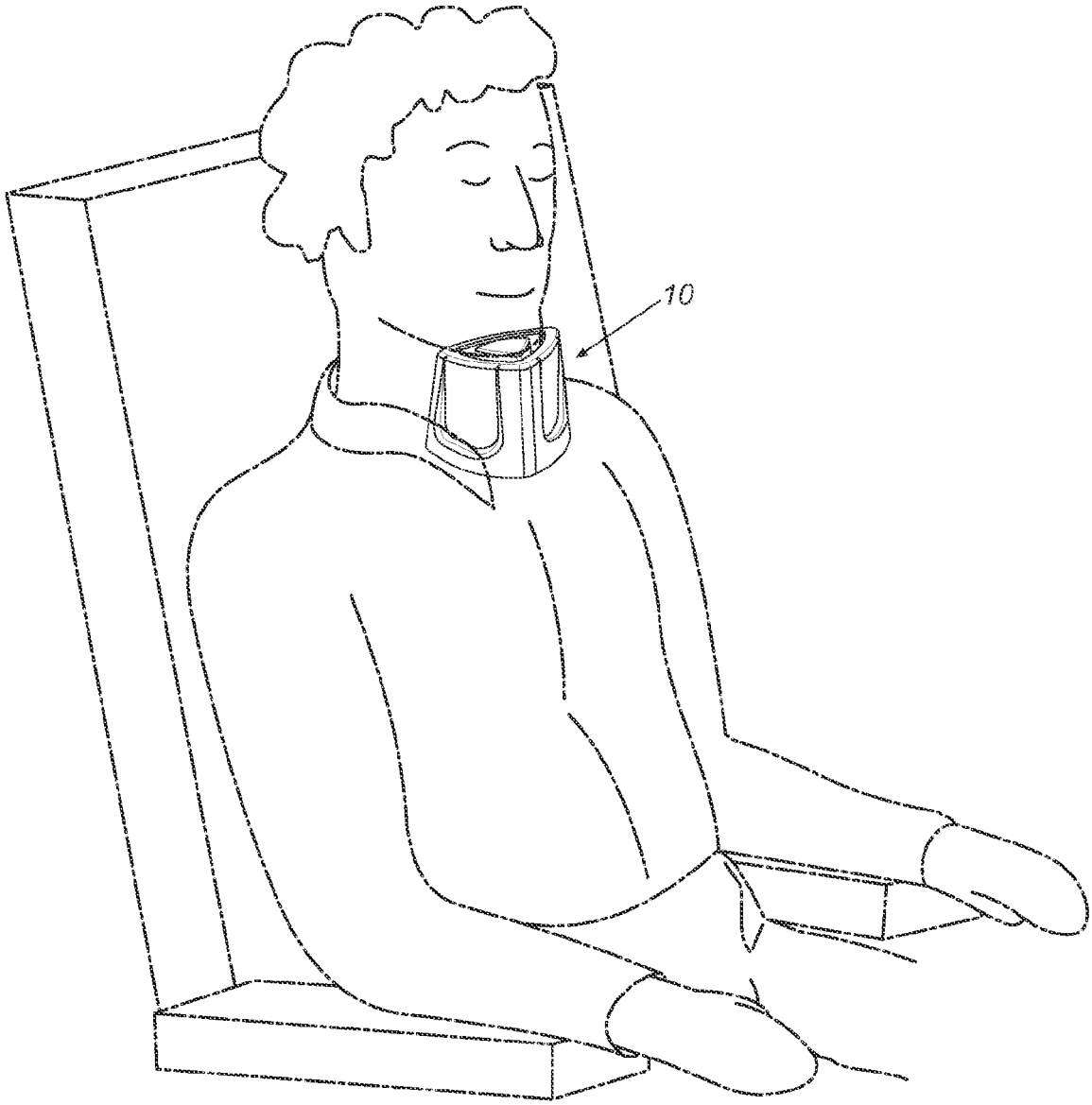
FIG. 7 is a perspective view of the travel pillow of FIG. 4 shown in use.

In use and referring to FIG. 7, the seated user places base 14 against their chest, at a point between the collar bones and body top portion 22 directly under their chin. The weight of the user's head will cause body 12 to compress a suitable distance so that the user's head is supported and prevented from tilting forward in a jerking motion as the user sleeps. As body top portion 22 compresses under the weight exerted by the user's chin, the user's chin is cradled within recessed portion 24 by body rim portion 26. The cradling action also prevents the user's head from violently tilting from side to side as the user sleeps.

During travel, the user may pack pillow 10 within their bags, purses or briefcase due to the small size of the pillow and its ability to compress under force. Pillow 10 does not require to be inflated as other travel pillows and maintains its shape due to the resiliency of the material. In some embodiments, the hollow center of body 12 may be filled with a filler to prevent excess compression if an air tight seal between body 12 and base 14 is sought. Examples of filler includes, but are not limited to, Styrofoam, Styrofoam beads, or other elastomer or polymer beads or stuffing materials that provide suitable compression. Other organic materials may also be used to fill the hollow portion of body 12 such as buckwheat hulls, such as are well-known in the art. Thus, not all embodiments of pillow 10 may require and air tight seal between body 12 and base 14.

What I claim:

1. A travel pillow adapted to be placed between a user's chin and chest. comprising:

a. a hollow shaped body formed from a resilient polymer having
  (i) a plurality of sidewalls extending generally parallel to a central longitudinal axis,
  (ii) a top surface centered about said central axis, said top surface being adapted to receive the chin of a user,
  (iii) a recess intermediate said top surface and said plurality of sidewalls, and
  (iv) an annular bottom edge; and b. a base formed from said resilient polymer having
  (i) a bottom surface,
  (ii) a vertical wall extending from said base, and
  (iii) a radial flange extending radially outward from the base vertical wall, wherein said base flange is fastened to said body annular bottom edge to form an airtight seal, and wherein said body sidewalls are less than approximately six inches tall.

2. The travel pillow of claim 1, wherein said resilient polymer is an injectable elastomer material.

3. The travel pillow of claim 1, wherein said resilient polymer is an injectable thermoplastic material.

4. The travel pillow of claim 1, wherein said body sidewalls are approximately three inches tall.

5. The travel pillow of claim 4, wherein said hollow shaped body compresses in height along said central longitudinal axis by approximately fifty percent.

6. The travel pillow of claim 1, further comprising resilient filler received within said hollow shaped body.

7. The travel pillow of claim 6, wherein said resilient filler comprises foam beads.

8. The travel pillow of claim 1, wherein said body is generally triangular in shape with respect to a cross-section taken perpendicular to said central longitudinal axis.

9. The travel pillow of claim 8, wherein said body comprises three sidewalls integrally formed with each other and said top surface.

10. The travel pillow of claim 1, wherein said body is fastened to said base by adhesive to create an airtight seam.

11. The travel pillow of claim 1, wherein said resilient polymer is a thermoplastic material.

12. A travel pillow adapted to be placed between a user's chin and chest comprising:

a. a triangular shaped body formed from a resilient polymer having
  (i) three sidewalls each having a first end and an opposite second end,
  (ii) a top surface centered about said central axis,
  (iii) a recess intermediate said top surface and said plurality of sidewalls, and
  (iv) an annular bottom edge; and b. a triangular shaped base formed from said resilient polymer, wherein said triangular shaped base is fastened to said body annular bottom edge so that an airtight seal is formed between said base and said body, wherein said body sidewalls are less than approximately six inches tall, and wherein said width between a sidewall and an apex of said other two walls is less than approximately six inches.

13. The travel pillow of claim 1, wherein said resilient polymer is an elastomer material.

* * * * *